United States Patent [19]

Rubinstein

[11] 4,167,895

[45] Sep. 18, 1979

[54] AXIAL PUMP WITH DISPLACEMENT CONTROL DEVICE

[75] Inventor: Jack Rubinstein, Fox Point, Wis.

[73] Assignee: The Oilgear Company, Milwaukee, Wis.

[21] Appl. No.: 918,880

[22] Filed: Jun. 26, 1978

[51] Int. Cl.[2] ..... F01B 13/04; F04B 1/26

[52] U.S. Cl. ..... 91/506

[58] Field of Search ..... 91/505, 506; 92/12.2; 417/222

[56] References Cited

U.S. PATENT DOCUMENTS

| | | | |
|---|---|---|---|
| 3,806,280 | 4/1974 | Bobier | 417/222 |
| 3,834,281 | 9/1974 | Heyl et al. | 91/506 |

FOREIGN PATENT DOCUMENTS

| | | | |
|---|---|---|---|
| 1114640 | 4/1956 | France | 91/506 |
| 1228951 | 4/1971 | United Kingdom | 91/506 |
| 1264827 | 2/1972 | United Kingdom | 91/506 |

*Primary Examiner*—William L. Freeh
*Attorney, Agent, or Firm*—Lloyd LaFave

[57] ABSTRACT

A variable displacement axial piston hydraulic pump or motor having a rotatable cylinder barrel with working pistons suitably connected for thrust engagement with the thrust face of a cradle supported for pivoted movement in one plane within a housing for the pump or motor to effect reciprocal movement of the working pistons in accordance with the tilt of the thrust face. The cradle has a rigid lever arm extending rearwardly of the face. A coupling pin is journalled in the lever arm; and a free end of the coupling pin has two flat sides fitted in an annular groove of a displacement control piston; whereby linear movement of the control piston transmitted through the coupling pin as the free end of the coupling pin slides laterally within the annular groove of the control piston to accommodate the angular movement of the cradle. And stops within the housing abut either side of the coupling pin intermediate the ends thereof to limit maximum displacement.

4 Claims, 5 Drawing Figures

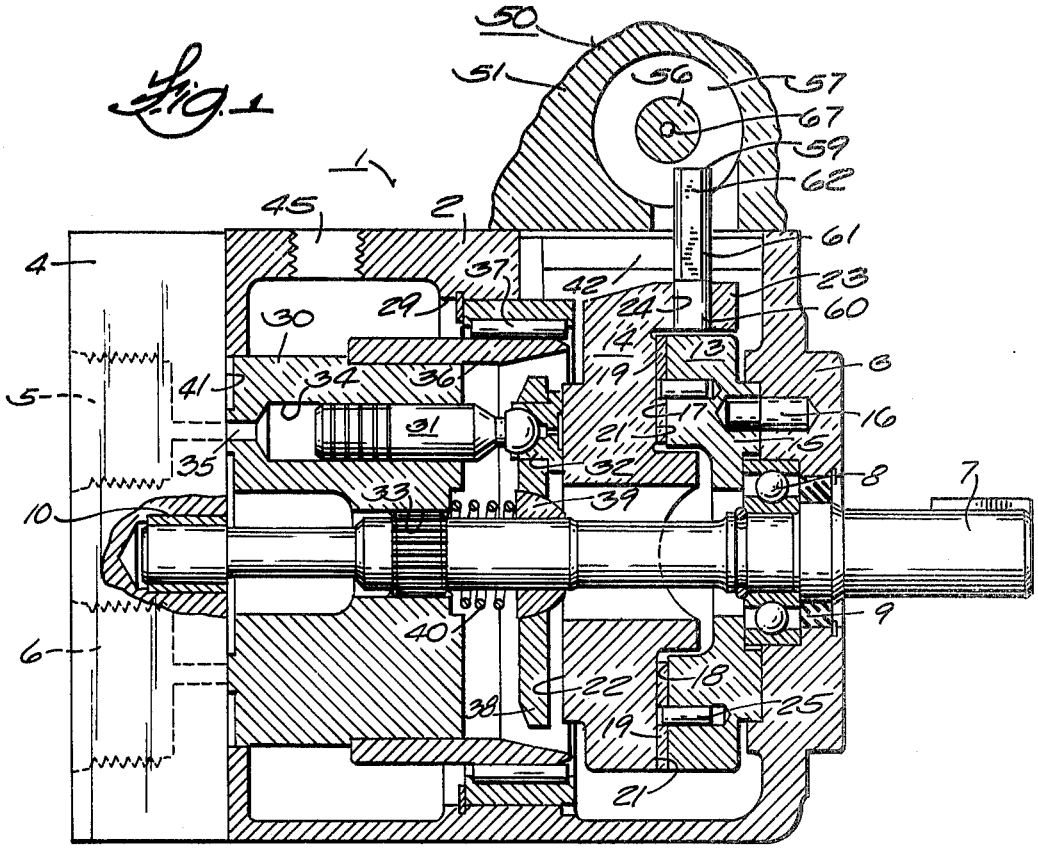
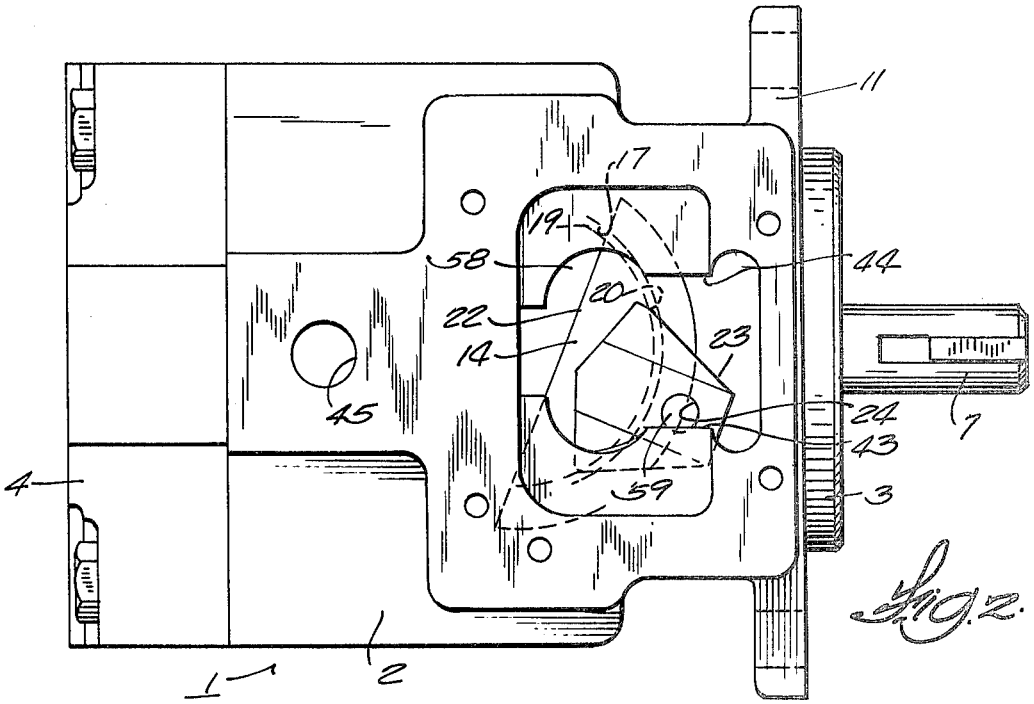
Fig. 2.

AXIAL PUMP WITH DISPLACEMENT CONTROL DEVICE

BACKGROUND OF THE INVENTION

The pertinent prior art is shown and described in U.S. Pat. No. 3,806,280 having a coupling means comprising a U-shaped clevis that overlies the arm of the cradle and slides thereon to accomodate angular movement of the cradle to the linear movement of a control member.

SUMMARY OF THE INVENTION

The invention relates to a control mechanism mounted on a side externally of a variable displacement hydraulic pump or motor, generally referenced herein only to a pump for a convenience. The control device has a control piston that moves transversely of the axis of the pump to tilt a cradle, yoke or swashplate, that is pivotally supported in an arcuate bearing within the housing, to vary the pump displacement.

Means coupling the control piston to the cradle includes a lever arm or plate on the cradle with a coupling pin journalled for rotation therein. A control force is applied transversely of coupling pin in a linear direction transversely of the axis of the pump. The control force is applied by the control piston which has an annular groove within which a free end of the coupling pin is fitted. The free end of the coupling pin has opposite flat side surfaces abutting the wall surfaces of the annular groove.

This arrangement prevents the coupling pin from rotating within the control pin and provides a good bearing surface for force transmission, and permits the coupling pin to slide sideways within the annular groove to accomodate the linear movement of the control piston to the arcuate movement of the cradle.

Stops are provided to limit the maximum displacement position for the control, by flat wall surfaces of an opening in the pump housing, which wall surfaces abut one or the other flat side surface of the coupling pin that extends through the opening in the housing.

It is an object of the invention to provide an improved coupling arrangement constructed and arranged as described above, that reduces the number of parts, is economical to make, and whose control piston may be a component part of either a manual, hydraulic or electrohydraulic control.

THE DRAWINGS

The following description refers by reference numerals to parts shown on the accompanying drawings, in which:

FIG. 1 is a longitudinal view of an axial piston pump with a part cut-away and shown in cross-section, and shows a cut away section of the control device mounted on the top side of the pump;

FIG. 2 is a top view of the pump shown in FIG. 1 with the control removed and with the cradle in a full stroke position;

DESCRIPTION OF AN EMBODIMENT

Figure 3:
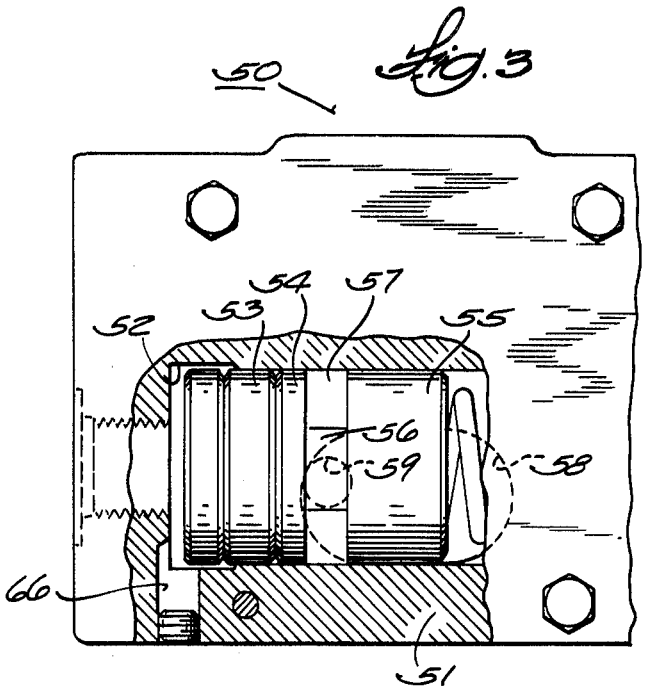
FIG. 3 is a top view of the control device with a part broken away and a part cut away and in section.
Figure 5:
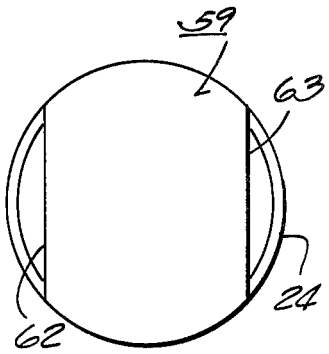
FIG. 5 is an enlarged end view of a coupling pin shown in the other drawings.

A positive displacement axial piston pump 1 also operable as a motor, FIG. 1, has a housing 2 closed at its right end by an end portion 3, and closed at its left end by an end head 4 having inlet and outlet ports 5, 6. A shaft 7, for operatively connecting to a drive device not shown, extends through a bore in the end portion 3 of the housing and is rotatably supported therein by a radial and thrust bearing 8. A seal 9 is secured within the bore to seal the shaft and bore. The other end of the shaft is supported in a sleeve bearing 10 fitted in a bore in the end head 4. The end portion 3 of the housing 2 carries a mounting flange 11, FIG. 2.

The pump 1 has a stationary and a rotating group of members. The stationary group includes a saddle 13 that provides a pivot support for a cradle 14. The saddle has an annular shoulder portion 15 on its right face located in a counterbore in the end portion 3 of the housing and secured against rotation therein by a pin 16. The saddle has a large axial bore and counterbore that spaces the saddle from the shaft 7 and bearing 8. The front or left face of the saddle 13 has two parallel arcuate surfaces 17, 18, whose central radii or pivot axes are parallel with the shaft and spaced on opposite sides thereof. Strip bearing material 19 is formed and laid on each arcuate bearing surface 17, 18, and secured by a pin 25.

The cradle 14 also has a large axial bore through which the shaft 7 extends. The cradle has a pair of arcuate bearing surfaces 20, 21 which seat in mating engagement on the strip bearing material or tracks on the bearing surfaces 17, 18 of the saddle 13.

The cradle has a front or left face that is flat and provides a thrust face 22 for work or pumping pistons of the rotating group of members. The cradle includes a broad lever arm 23 integral therewith that extends rearwardly of the front face and overlies the top of the saddle, FIGS. 1 and 2. The lever arm 23 has a bore 24 centered rearwardly of the cradle bearing surfaces 20, 21 for coupling to a control device hereinafter described.

The rotating group of members includes a cylinder barrel 30, axial piston 31 and a retaining harness 38 for bearing shoes 32 for the pistons. The cylinder barrel 30 is connected by a spline 33 to the shaft 7, in a known manner, for rotation with the shaft 7. The cylinder barrel has circumferentially spaced axial bores 34, each having a cylinder port 35, and each contain an axial piston 31 for reciprocating motion therein. The cylinder barrel has an annular race 36 pressed thereon that serves as the inner race of a radial bearing 37 located in a bore 29 in the housing 2 such that the bearing 37 is centered on a normal plane through the pivot centers of the piston shoes 32.

Each piston 31 and piston shoe 32 has a ball and socket connection with each other, and a harness plate 38 has holes with the shoes fitted therein and with the plate abutting shoulders of the shoes. The harness plate has a spherical bore riding on a spherical outer surface of a coller 39 journalled on shaft 7. A spring 40, arranged coaxial of shaft 7, is confined between the cylinder barrel 30 and the collar 39 to urge the collar and harness assembly to the right to hold the piston shoes against the thrust face of the cradle 14.

The face 41 of the end head 4 serves as a valve plate having a pair of arcuate ports, not shown, with which the cylinder ports 35 alternately register upon rotation of the cylinder barrel. These arcuate valve ports are connected respectively to an inlet or outlet ports 5 or 6.

A drain port 45 is provided in the top of the housing 2 for draining fluid from the housing and returning it to a reservoir, not shown.

Pump displacement control means comprises a control device 50 having a housing 51 mounted on a side of the pump 1 parallel to the plane of swing movement of the cradle 14. The control device has a cylinder 52 and a piston 53 therein for linear movement in a plane parallel to the plane of swing movement of the cradle and normal to the axis of the pump. The piston 53 has a pair of spaced apart lands 54, 55 joined by a rod or shank portion and define an annular groove 57 in the piston. The cylinder has a wide elongated slot 58 in its bottom which is open to the annular groove 57 in the piston for the extent of its travel in the cylinder. Means positioning the control piston is not shown, but may comprise any conventional mechanical, hydraulic, electrohydraulic, or mechanical operating means.

A coupling between the control piston 53 and the cradle 14 of the pump comprises a compling pin 59 that extends normal to the control piston and to the arm 23 of the cradle and extends through the housing 51 of the control device and through an opening 42 in the housing 2 of the pump. The opening in the pump housing has opposite sides 43, 44 serving as stops that respectively abut a flat side 62 or 63 of coupling pin 59 upon a predetermined maximum stroke of the pump in either direction.

The coupling pin 59 is made from a rigid rod stock, one end is cylindrical and the other end is ground flat on two sides. The cylindrical end 60 thereof is journalled in a bore 24 in the arm of the cradle 14. The other end 61 of the coupling pin is a free end that extends into the annular groove 57 in the control piston 53 such that the flat sides 62, 63 of the coupling pin are fitted between the shoulders of the lands 54, 55 of the control piston 53.

The free end of the coupling pin 59 underlies and is spaced slightly underneath the shank or rod section 56 of the control piston, and is aligned off-center therewith when the control piston and cradle are at neutral position or zero pump displacement.

The free end of the coupling pin having two flat sides 62, 63 fitted between the shoulders of the lands 54, 55, which define the annular groove 57 of the control piston and cannot rotate therein but does slide latterally therein under the shank or rod section 56 of the control piston 53 upon displacement of the control piston. The control pin 59 being carried by the arm 23 of the cradle, by its journalled connection therewith, rotates relative to the arm as the arm swings in an arcuate path upon displacement of the control piston. Thus the coupling pin is displaced along the linear path of the control piston while sliding transversely within the control piston to accomodate the arcuate movement of the cradle, without lost motion therebetween.

The control device 50 has the piston 53 biased by a spring 64 confined between the piston and the end of the housing, the spring urging the piston in a direction for maximum stroke of the pump. The end of the cylinder 52 is open to a port 65 adapted to receive pressure fluid from a pressure port of the pump 1. Or port 65 may be plugged and a port 66 unplugged and used instead which is adapted to be connected internally in the pump housing to the pump pressure port 4 or 5.

Figure 4:
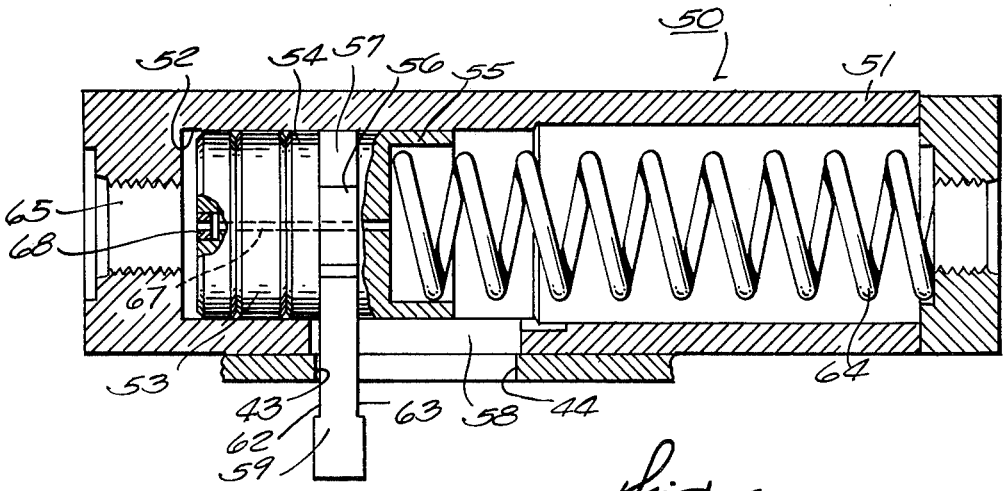
FIG. 4 is a side view of the control device shown in cross-section, and the control piston shown partially in cross-section.

In the mode of operation for the control device illustrated in FIGS. 3 and 4, the control piston 53 is urged to the left by the spring 64, to a position where a flat side 62 of coupling pin 59 abuts the stop 43 provided by the wall of the opening 42 in the housing 2 of the pump 1. Therefore the cradle 14 is tilted to maximum stroke position for the pump. Upon start-up of the pump, pump delivery pressure is supplied to port 65 of the control device and this pressure is applied to control piston 53 urging it to the right, in opposition to the bias spring 64, to reduce pump stroke to a position for maintaining a predetermined pump pressure. Passage 67 through the control piston 53 and choke 68 bleeds pressure fluid from control cylinder 52 through the piston 53 to the interior of the housing 2 to minimize oscillations of the control.

In reducing pump stroke, the control pin 59 carried by the cradle 14 in FIGS. 1 and 2, moves with the control piston from left to right in FIGS. 3 and 4, and also slides transversely of the control piston which is to the right in FIG. 1. The flat sides 62, 63 of the free end of the control piston have a sliding fit with the walls of the annular groove 57 of the piston 53.

I claim:

1. A positive displacement axial piston pump or motor comprising a housing, a cradle pivotally supported in the housing and having a thrust face whose angle of inclination to the axis of the pump determines the stroke or displacement of the pump or motor, said cradle having a lever arm on the a side of the cradle and extending rearwardly of the thrust face, a control device mounted on a side of the housing adjacent said lever arm and having a control piston parallel with the plane of the lever arm and that moves transversely of the lever arm and the axis of the pump or motor, said control piston having a pair of lands defining an annular groove therebetween, an opening in a housing for said control piston and an opening in the housing for said pump or motor and overlying said lever arm, said lever arm having a bore generally aligned with said annular groove in the control piston, and a coupling pin having a cylindrical end and a free end having opposite flat side surfaces, the cylindrical end journalled in said bore of said lever arm, the free end extending into said annular groove of said control piston with the flat side surfaces of the free end making a sliding fit with the wall surfaces of the annular groove, and the free end of the coupling pin underlying a shank portion of the control piston so the coupling pin is free to slide transversely thereunder.

2. The pump or motor as defined in claim 1 wherein the opening in its housing through which the coupling pin extends defines a stop which abuts a side of the coupling pin intermediate the ends thereof and adjacent to the lever arm to limit the maximum movement of the control piston.

3. The pump or motor as defined in claim 1 wherein the annular groove in the control piston and the spring biased end of the control piston are in open communication with the interior of the housing of the pump or motor.

4. The pump or motor as defined in claim 1 wherein the coupling pin is aligned off-center with respect to the axis of the control piston when the cradle is at zero stroking position and as the control piston is displaced toward maximum stroke position the coupling pin slides transversely in the annular groove in a direction toward the axis of the control piston.

* * * * *